US009750390B2

(12) United States Patent
Flores et al.

(10) Patent No.: US 9,750,390 B2
(45) Date of Patent: Sep. 5, 2017

(54) DISH TREATING APPLIANCE WITH WINDOW INSERT

(71) Applicant: Whirlpool Corporation, Benton Harbor, MI (US)

(72) Inventors: Juan F. Flores, Stevensville, MI (US); Daniel W. Southworth, South Bend, IN (US); Anthony B. Welsh, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/953,523

(22) Filed: Nov. 30, 2015

(65) Prior Publication Data

US 2017/0150867 A1 Jun. 1, 2017

(51) Int. Cl.

| | |
|---|---|
| ***A47L 15/00*** | (2006.01) |
| ***A47L 15/42*** | (2006.01) |
| ***A47B 81/00*** | (2006.01) |

(52) U.S. Cl.

CPC ..... *A47L 15/4257* (2013.01); *A47B 81/00* (2013.01); *A47L 15/4263* (2013.01)

(58) Field of Classification Search

CPC .... A47L 15/4257; A47L 15/4263; E06B 3/66; E06B 3/6621; E06B 3/663; E06B 3/66319

See application file for complete search history.

(56) References Cited

U.S. PATENT DOCUMENTS

| | | | | |
|---|---|---|---|---|
| 3,389,522 | A * | 6/1968 | Hordis | E06B 3/24 52/204.599 |
| 4,998,382 | A | 3/1991 | Kostos et al. | |
| 5,061,531 | A | 10/1991 | Catalano | |
| 5,255,473 | A | 10/1993 | Kaspar et al. | |
| 5,589,958 | A * | 12/1996 | Lieb | A47F 3/007 312/114 |
| 5,924,433 | A * | 7/1999 | Thies | A47L 15/4246 134/179 |
| 6,135,130 | A * | 10/2000 | Martineau | A61L 2/26 126/200 |
| 6,561,180 | B1 * | 5/2003 | Austin | F24C 15/04 126/190 |
| 6,793,990 | B1 | 9/2004 | Sakaguchi et al. | |
| 8,523,300 | B2 * | 9/2013 | Bernal | D06F 39/14 312/228 |

(Continued)

FOREIGN PATENT DOCUMENTS

| | | | |
|---|---|---|---|
| DE | 19714515 | A1 | 10/1998 |
| GB | 2141165 | A | 12/1984 |

*Primary Examiner* — Daniel Rohrhoff

(74) *Attorney, Agent, or Firm* — McGarry Bair PC

(57) ABSTRACT

A dish treating appliance for treating dishes according to an automatic cycle of operation includes a tub at least partially defining a treating chamber for receiving dishes for treatment according to the automatic cycle of operation, an access opening provided in the tub and through which is had access to the treating chamber, and a door movable relative to the tub to selectively open and close the access opening, the door having an inner surface confronting the access opening when the door closes the access opening, an outer surface, opposite the inner surface, and a window assembly provided in the door and having inner and outer panes.

20 Claims, 9 Drawing Sheets

(56) References Cited

U.S. PATENT DOCUMENTS

| | | | | |
|---|---|---|---|---|
| 9,538,900 | B2 * | 1/2017 | Kutto | A47L 15/4257 |
| 2005/0034486 | A1 * | 2/2005 | Bienick | F24C 15/04 68/3 R |
| 2013/0214664 | A1 | 8/2013 | Yoon et al. | |
| 2015/0005943 | A1 * | 1/2015 | Bodine | D06F 37/28 700/275 |
| 2015/0173586 | A1 | 6/2015 | Kutto et al. | |
| 2015/0374200 | A1 * | 12/2015 | Kutto | A47L 15/4263 312/228 |

* cited by examiner

DISH TREATING APPLIANCE WITH WINDOW INSERT

BACKGROUND

A conventional automated dish treating appliance includes either a hinged or sliding door that selectively provides access to a treating chamber in which dishes are placed for treatment according to an automatic cycle of operation. Some doors may be provided with a window assembly through which the treating chamber may be visible from an exterior of the dish treating appliance. The window provides an additional component in the dish treating appliance which must be provided within the dish treating appliance in such a manner as to minimize the leakage of fluid from the treating chamber to other parts of the dish treating appliance or to the exterior of the dish treating appliance.

BRIEF SUMMARY

An embodiment of the invention relates to a dish treating appliance for treating dishes according to an automatic cycle of operation, in which the dish treating appliance comprises a tub at least partially defining a treating chamber for receiving dishes for treatment according to the automatic cycle of operation and an access opening provided in the tub and through which is had access to the treating chamber. A door is movable relative to the tub to selectively open and close the access opening and has an inner surface confronting the access opening when the door closes the access opening, and an outer surface opposite the inner surface. A window assembly is provided in the door having spaced and sealed inner and outer panes sandwiched between inner and outer frame elements that are connected by a waterproof weld joint.

DETAILED DESCRIPTION

Figure 1:
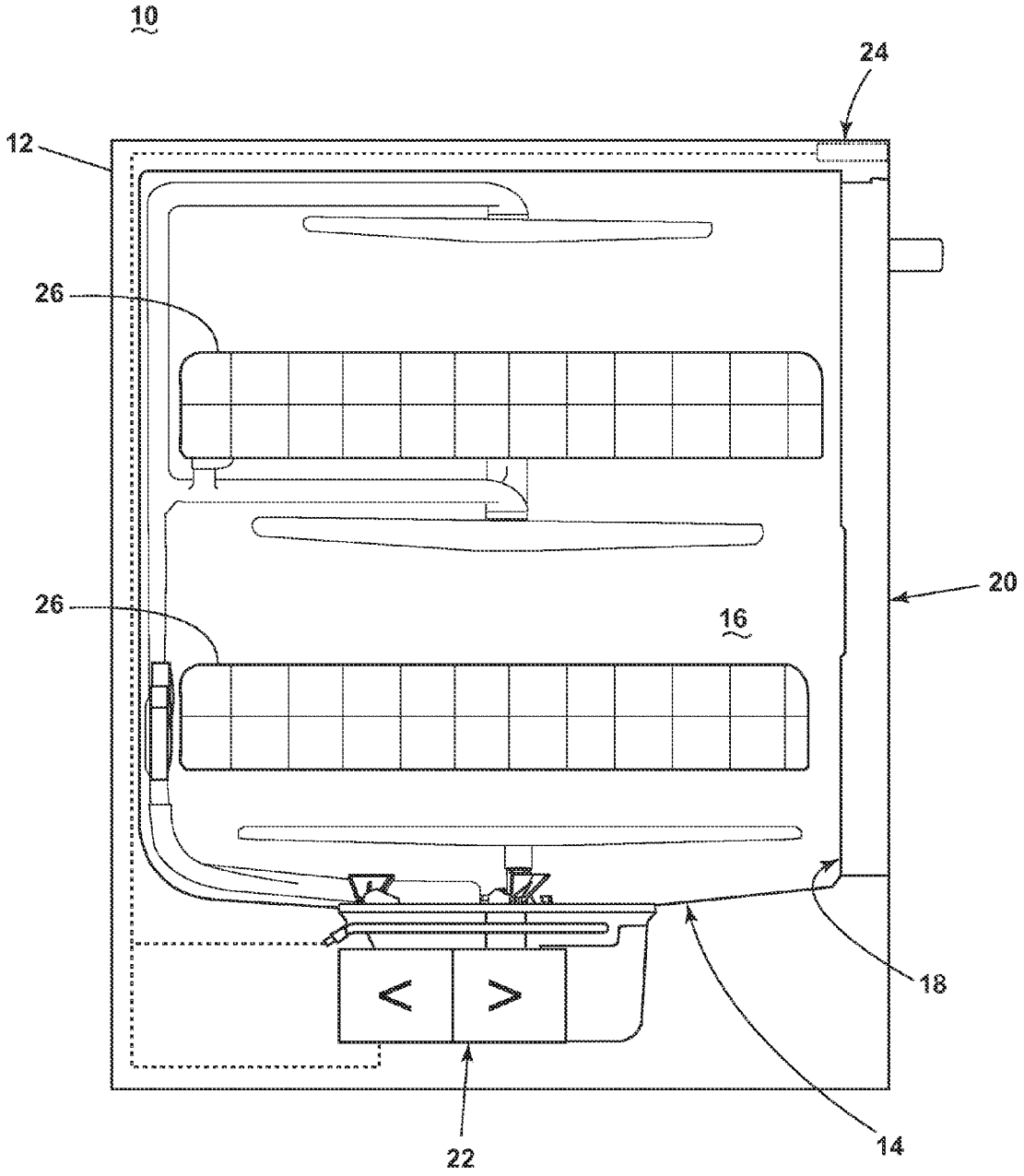
FIG. 1 is a schematic, cross-sectional view of a dish treating appliance with a door closed according to an embodiment of the invention.

FIG. 1 is a schematic illustration of a dish treating appliance 10 that shares many features of a conventional automated dish treating appliance, which will not be described in detail herein except as necessary for a complete understanding of the invention. The dish treating appliance 10 may include a chassis 12 defining an interior of the dish treating appliance 10 and may include a frame, with or without panels mounted to the frame. A tub 14 may be provided within the chassis 12, and may at least partially define a treating chamber 16 for receiving dishes for treatment according to the automatic cycle of operation and further include an open face 18 defining an access opening to the treating chamber 16.

A door assembly 20 may be movably mounted to the dish treating appliance 10 for movement between opened and closed positions to selectively open and close the open face 18 of the tub 14. Thus, the door assembly 20 provides accessibility to the treating chamber 16 for the loading and unloading of dishes or other washable items. When the door assembly 20 is closed, user access to the treating chamber 16 may be prevented, whereas user access to the treating chamber 16 may be permitted when the door assembly 20 is open. The door assembly 20 may be hingedly connected with the chassis 12 or slidingly attached to a drawer slide system to selectively provide access to the treating chamber 16.

Additional features, such as a liquid supply and circulation system 22, including one or more liquid supply and drain conduits, sprayers and/or pumps, a control system 24 including one or more controllers and a user interface, one or more dish racks 26, and any other alternative or additional features used in a conventional automatic dish treating appliance may also be provided in the dish treating appliance 10 without deviating from the scope of the invention.

Figure 2:
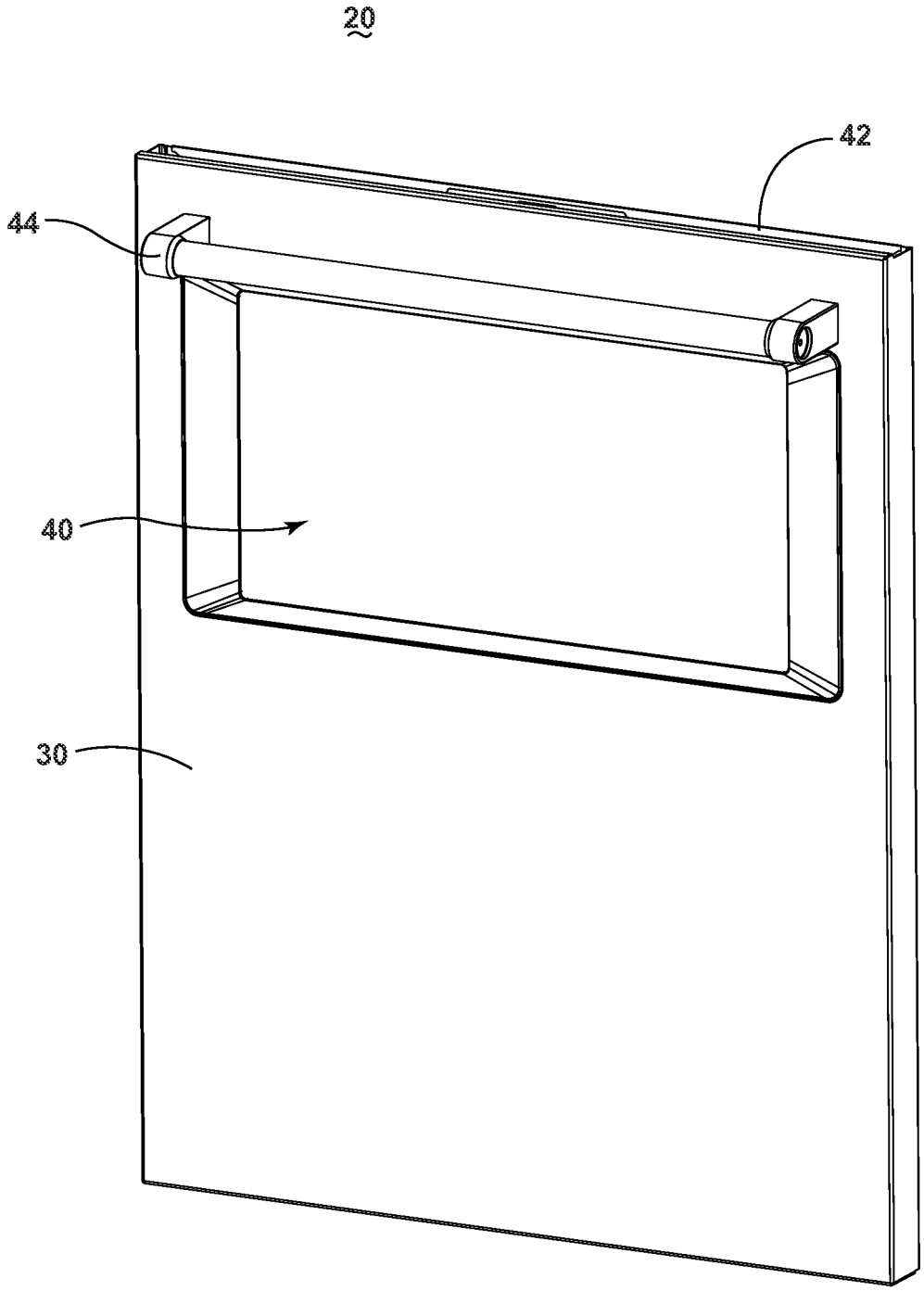
FIG. 2 is a front perspective view of a door assembly for a dish treating appliance according to an embodiment of the invention, with the door assembly having an inner and outer panel.

Referring now to FIG. 2, the door assembly 20 may include an exterior door panel 30, a window assembly 40, and an interior door panel 42 which faces the treating chamber 16 of the dish treating appliance 10 and confronts the access opening when the door assembly 20 is in the closed position. The exterior door panel 30 is opposite the interior door panel 42 and may be coupled with the interior door panel 42 to collectively form a door using any suitable mechanical and/or non-mechanical fasteners, non-limiting examples of which include screws, pins, clips, welds and adhesives. It is also within the scope of the invention for the door to be in the form of a single piece door that does not include separate interior and exterior panels. The door assembly 20 may include additional features, such as a handle or grip 44, a treating chemistry dispenser, and/or a user interface, the details of which are not germane to the embodiments of the invention. The window assembly 40 may provide a user with a view of at least a portion of the treating chamber 16 from an exterior of the dish treating appliance 10.

Figure 3A:
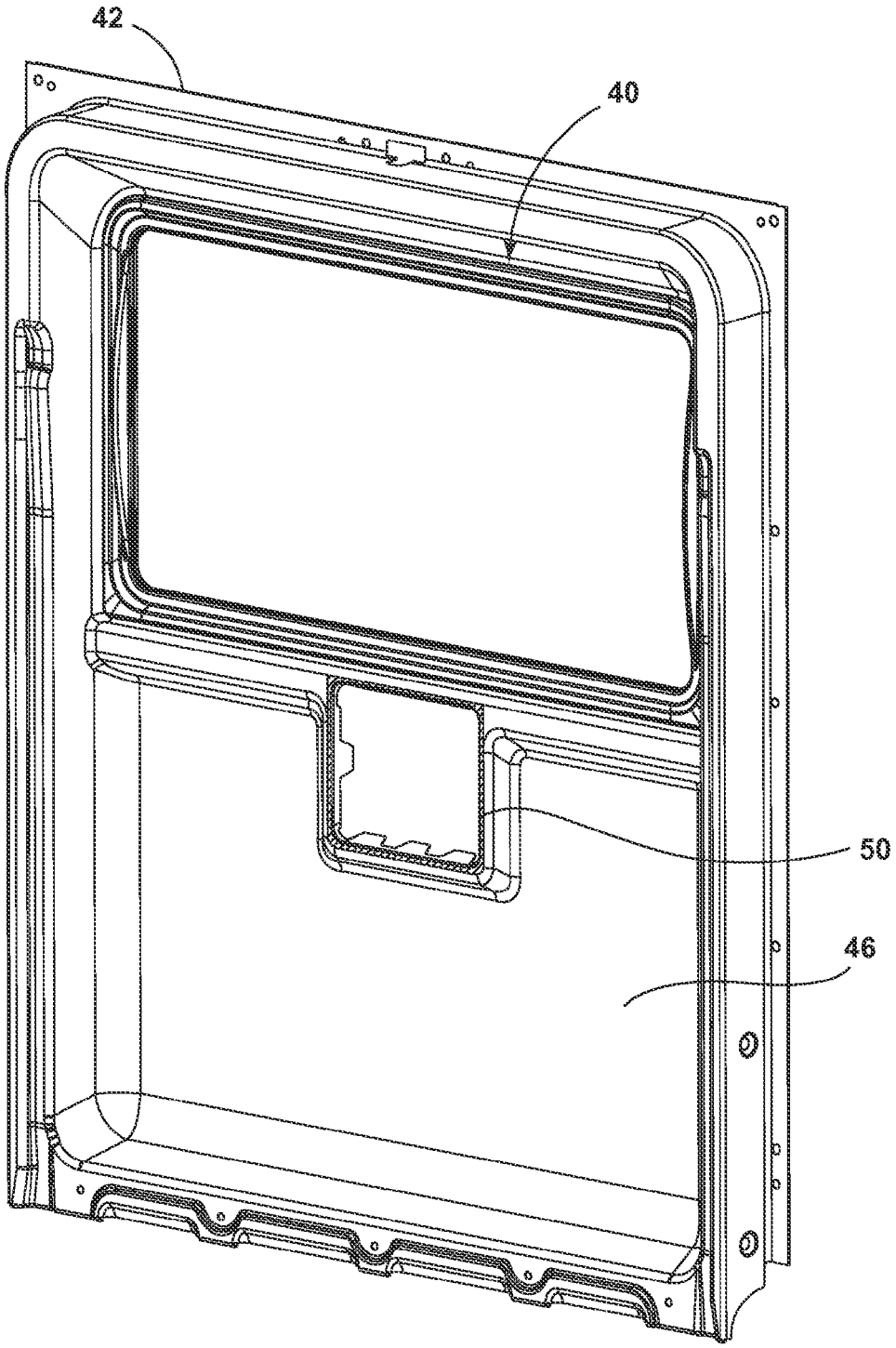
FIG. 3A is a rear perspective view of an interior side of the inner door panel assembly of the door assembly of FIG. 2 according to an embodiment of the invention.
Figure 3B:
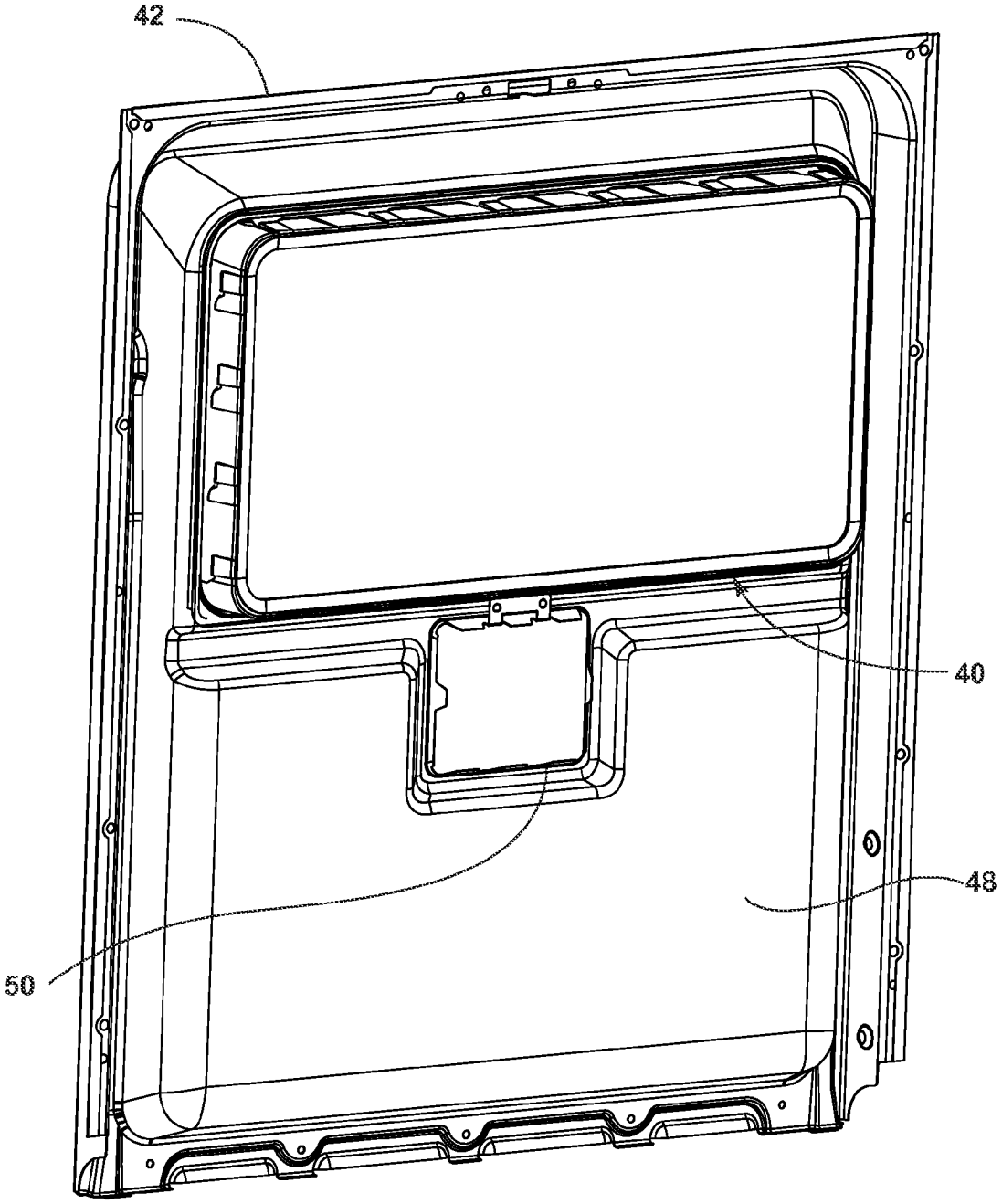
FIG. 3B is a front perspective view of an exterior side of the inner door panel assembly of the door assembly of FIG. 2 according to an embodiment of the invention.

FIGS. 3A and 3B illustrate an inner surface 46 (FIG. 3A) and an outer surface 48 (FIG. 3B) of the interior door panel 42 having the window assembly 40 mounted therein forming an interior door panel assembly. The inner surface 46 of the interior door panel 42 faces the treating chamber 16 of the dish treating appliance 10 while the outer surface 48 faces away from the treating chamber 16 towards the exterior of the dish treating appliance 10 and is adjacent an inner surface of the exterior door panel 30. The interior door panel 42 can optionally be provided with an aperture 50 for supporting a dispenser, as is known in the art.

Figure 4:
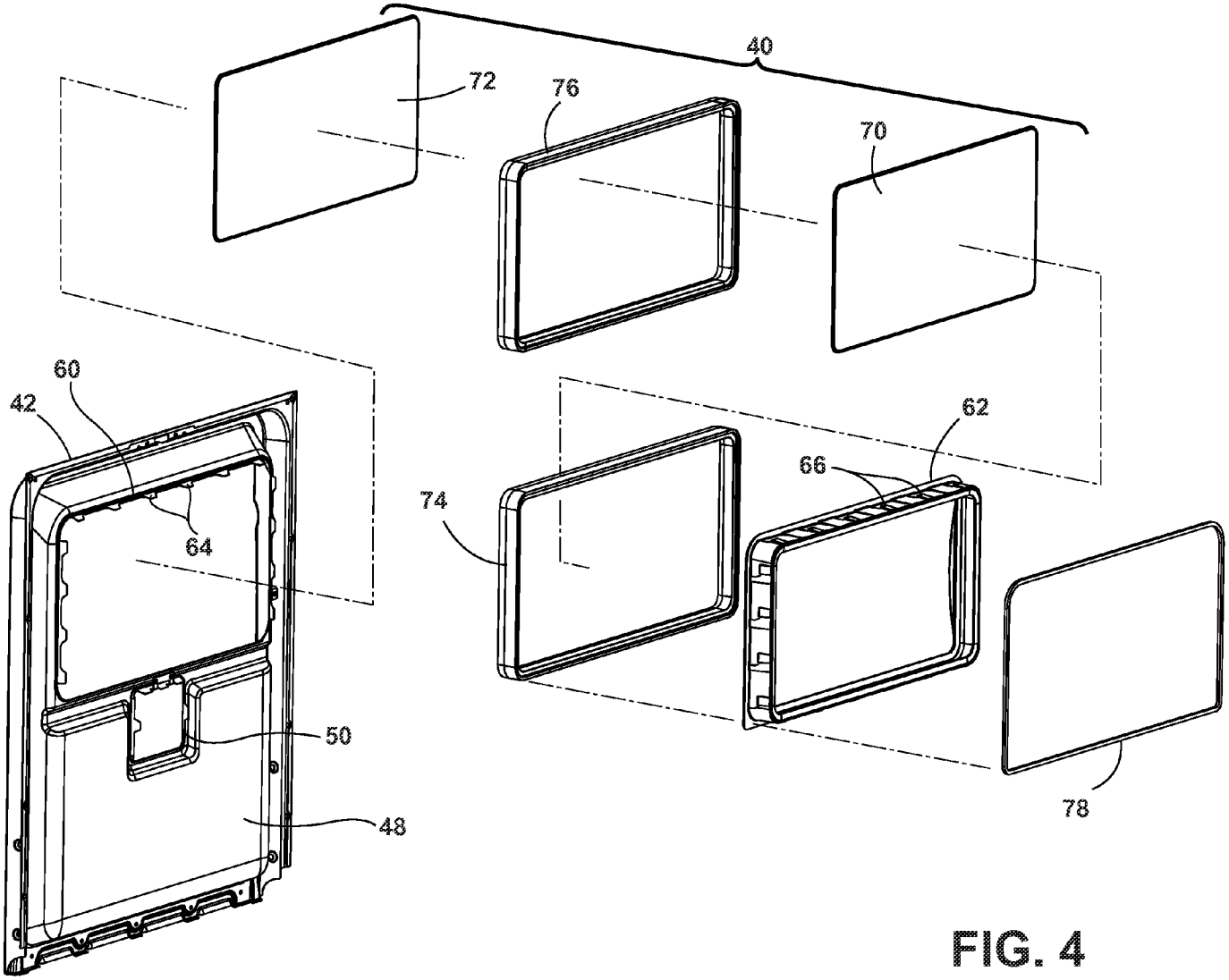
FIG. 4 is an exploded view of the inner door panel assembly of FIGS. 3A-3B according to an embodiment of the invention.

Referring now to FIG. 4, the interior door panel 42 includes an interior window opening 60. The window assembly 40 can include a peripheral frame 62 to support the window assembly 40 in at least partial alignment with the interior window opening 60. The interior door panel 42 may include a plurality of mounting flanges 64 defining the interior window opening 60 which engage aligned detents 66 for engaging the peripheral frame 62 to support the peripheral frame 62 within the interior window opening 60. The mounting flanges 64 may be resilient flanges that flex outward as the peripheral frame 62 is inserted through the interior window opening 60 and the mounting flanges 64 engage the detents 66 and then return to their un-flexed position to engage the peripheral frame 62 when the detents 66 pass a terminal edge of the mounting flanges 64. Alternatively, or additionally, the mounting flanges 64 may be in the form of flanges having apertures for receiving fasteners that are inserted into aligned apertures in the peripheral frame 62.

Figure 5:
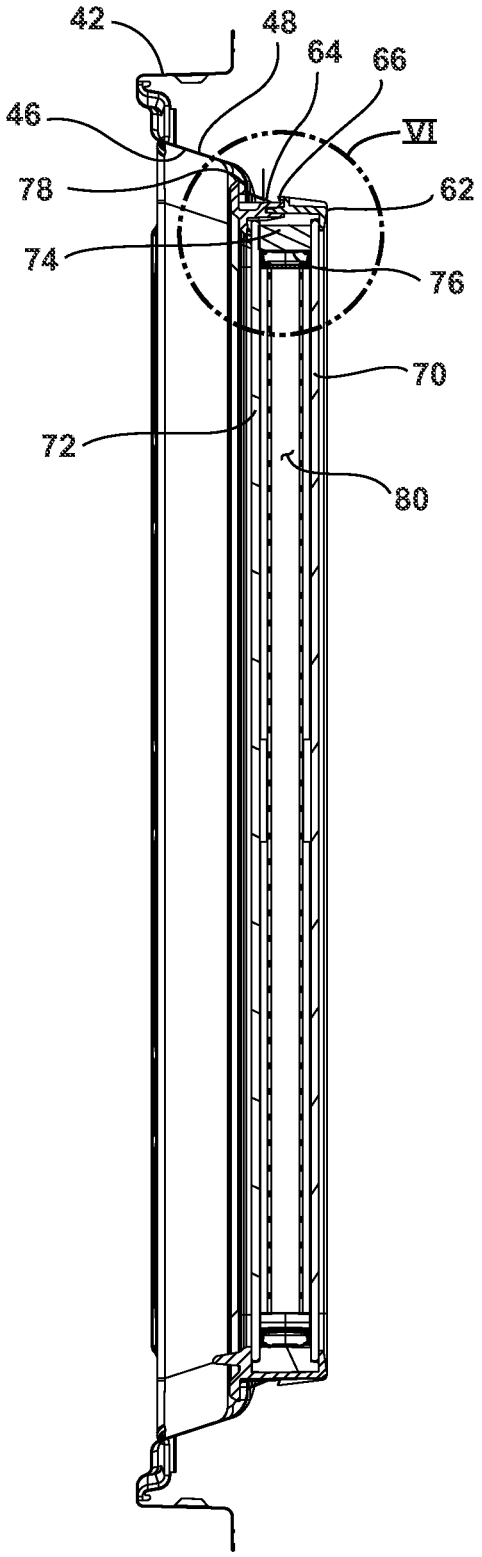
FIG. 5 is a cross-sectional view of the inner door panel assembly of FIGS. 3A-3B according to an embodiment of the invention.

Referring now to FIG. 5, the window assembly 40 may include a first or outer window pane 70, a second or inner window pane 72, a spacer 74, an edge seal element 76, and an optional seal 78 provided between the inner surface 46 of the interior door panel 42 and the peripheral frame 62. The first and second window panes 70, 72 may be made from a material that is at least partially transparent such that light may travel through the window assembly 40 from the treating chamber 16 to an exterior of the dish treating appliance 10 such that a user may view at least a portion of the treating chamber 16 from the exterior of the dish treating appliance 10. The first and second window panes 70, 72 can be made from glass, tempered glass, borosilicate glass, or ceramic glass or transparent plastics, such as acrylic, polycarbonate, nylon, or acrylonitrile-butadiene-styrene (ABS). In another example, the first and/or second window panes 70, 72 may be made from materials having light transmission properties that change when voltage, light or heat is applied. Non-limiting examples of such materials include electrochromic, photochromic, and thermochromic materials. In one example, the first and/or second window panes 70, 72 may be made from a polymer dispersed liquid crystal device in which the light transmission properties may be changed by modifying the voltage applied to the material.

Figure 6:
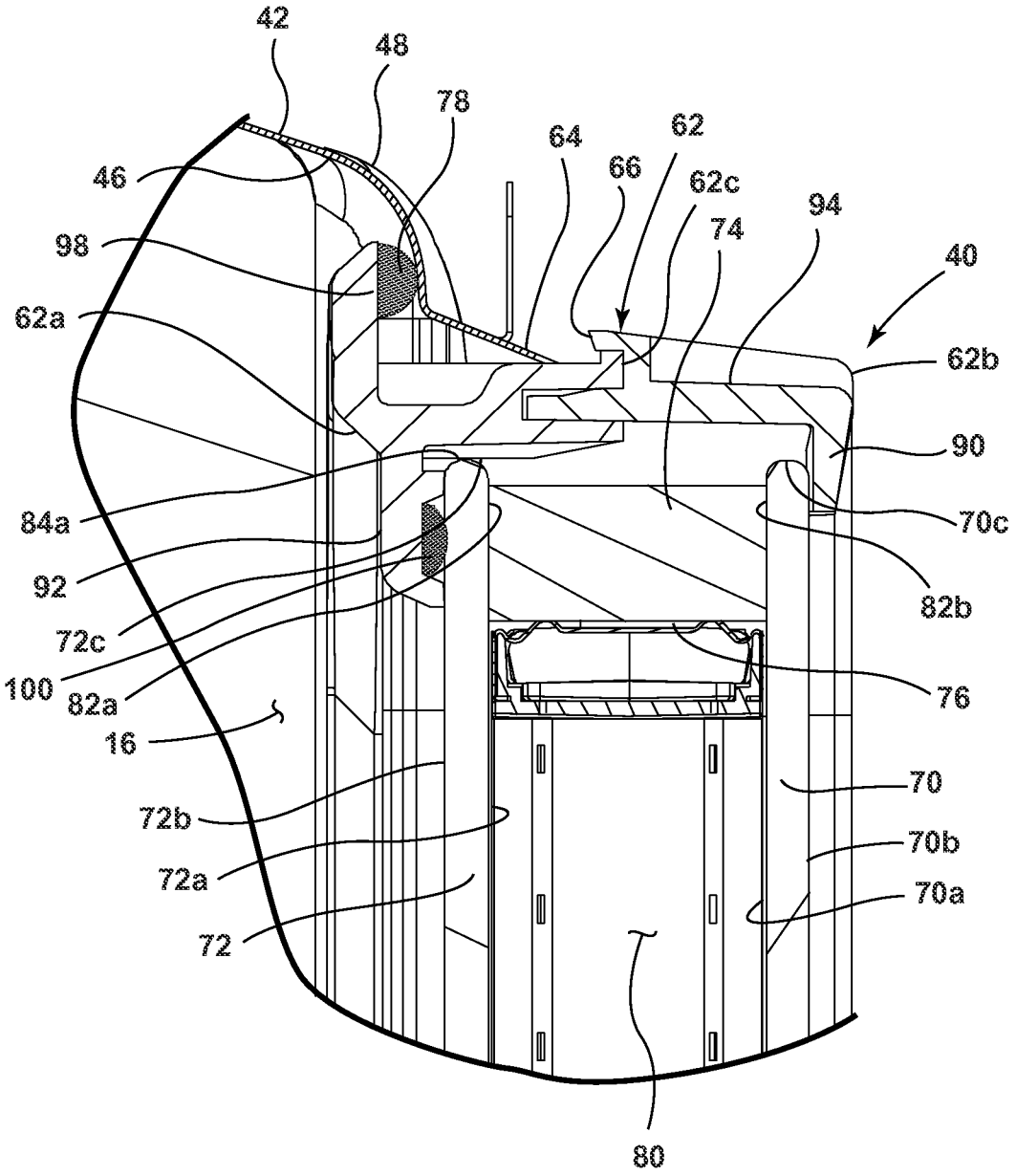
FIG. 6 is an enlarged cross-sectional view of a portion of the inner door panel assembly indicated in FIG. 5 according to an embodiment of the invention.

Referring now to FIG. 6, each window pane 70, 72 includes an inner surface 70*a*, 72*a*, and outer surface 70*b*, 72*b*, and a peripheral edge 70*c*, 72*c*, with the inner surfaces 70*a*, 72*a* in a confronting relationship. The spacer 74 is provided between the confronting inner surfaces 70*a*, 72*a* and adjacent to the peripheral edges 70*c*, 72*c* of the window panes 70, 72 to maintain the outer and inner window panes 70, 72 in a spaced relationship and define a chamber 80 therein. The spacer 74 can have a generally rectangular cross-section. The spacer 74 has a first, inner surface 82*a* adjacent the inner surface 72*a* of the inner window pane 72 and a second, outer or exterior surface 82*b* adjacent the inner surface 70*a* of the outer window pane 70.

The peripheral frame 62 has a generally "C-shaped" interior cross-section that receives the spacer 74, the peripheral edge 70*c*, 72*c*, and at least a portion of the outer surface 70*b*, 72*b* of the outer and inner window panes 70, 72 adjacent the spacer 74 and peripheral edges 70*c*, 72*c* and extends about the perimeter of the spacer 74 and peripheral edges 70*c*, 72*c*. The peripheral frame 62 comprises an inner frame element 62*a* and an outer frame element 62*b* that are joined together at a waterproof weld joint 62*c*. The waterproof weld joint 62*c* comprises a channel on one of the inner or outer frame elements 62*a*, 62*b* and a weld flange on the other of the inner or outer frame elements 62*a*, 62*b*, with the weld flange received within the channel and the flange and the channel welded together. The waterproof weld joint 62*c* extends about the peripheral edges 70*c*, 72*c* of the outer and inner window panes 70, 72. The waterproof weld joint 62*c* provides a continuous and waterproof connection between the inner and outer frame elements 62*a*, 62*b* along the entirety of the length of the peripheral frame 62. While it is contemplated that any suitable method of providing a continuous waterproof weld joint 62*c* can be employed, an exemplary embodiment utilizes EMABOND to provide the waterproof weld joint 62*c*. EMABOND is a commercially available product comprising an extruded polypropylene rope having ferrous material embedded therein, such that the ferrous particles can be excited by an electromagnet and made to form a waterproof weld joint 62*c* without causing vibration or other disturbances to the glass panes 70, 72 of the window assembly 40.

The overall profile of the peripheral frame 62 can include opposing outer and inner flanges 90 and 92, respectively, connected by a horizontal leg 94. The inner frame element 62*a* comprises the inner flange 92 and the innermost portion of the horizontal leg 94, while the outer frame element 62*b* comprises the outer flange 90 and the outermost portion of the horizontal leg 94. The inner flange 92 overlies the outer surface 72*b* of the inner pane 72, extending about a periphery of the inner pane 72. The outer flange 90 overlies the outer surface 70*b* of the outer pane 70, extending about a periphery of the outer pane 70. The inner flange 92 and the outer flange 90 compressively retain the inner and outer panes 72, 70. The outer flange 90 can be in the form of a trim bezel. The inner frame element 62*a* can further include a second flange 98 extending radially away from the panes 70, 72 and the "C-shaped" portion of the peripheral frame 62 and overlying the inner surface 46 of the interior door panel 42 and configured to seal with the interior door panel 42 through the optional seal 78, which can be in the form of a sealant and/or a gasket.

The window assembly 40 can further include a second, inner seal 100 that is provided between the inner frame element 62*a* and the inner pane 72. Specifically, the inner seal 100 is positioned between the inner flange 92 of the inner frame element 62*a* and the outer surface 72*b* of the inner pane 72, co-extending about the periphery of the inner pane 72 along with the inner flange 92. The inner pane 72 is configured to seal with the inner flange 92 of the inner frame element 62*a* through the inner seal 100, which can be in the form of a sealant and/or a gasket. Non-limiting examples of suitable materials of the inner seal 100 include a foam-in-place seal or a silicone foam seal.

Still referring to FIG. 6, the edge seal element 76 is provided between the confronting inner surfaces 70*a*, 72*a* of the window panes 70, 72 adjacent the spacer 74 and extending about the perimeter of the spacer 74. The edge seal element can be in the form of any suitable edge seal element providing a desiccant material, air gaps, and/or gas filled areas. Non-limiting examples of suitable edge seal elements include a hollow spacer frame filled with desiccant beads or an insulating glass edge spacer system, such as DURALITE® or DURASEAL®, available from Quanex, U.S.A., which provide a desiccant and vapor barrier seal.

Figure 7:
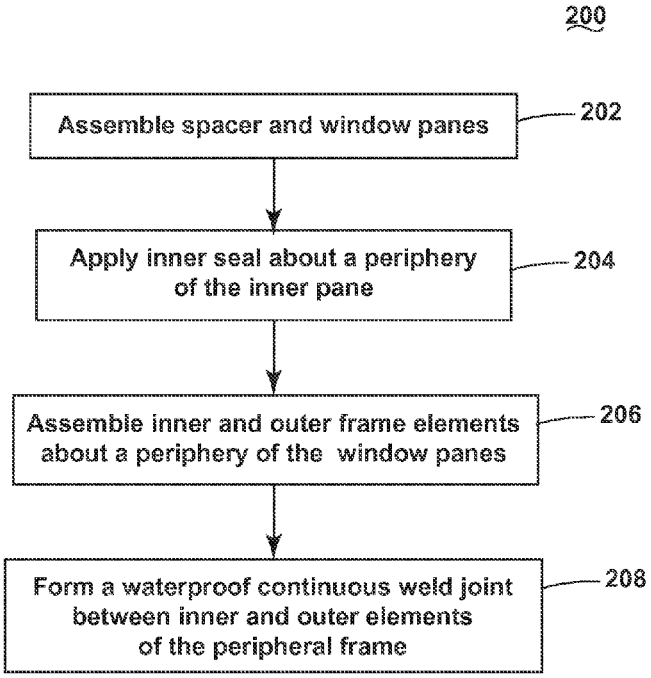
FIG. 7 is a flow chart of a process for forming a window assembly for use with the door assembly of FIG. 2 according to an embodiment of the invention.

FIG. 7 illustrates an exemplary process 200 for assembling any of the window assemblies described herein and will be described in the context of the window assembly 40. The process 200 can be used to form a leak-proof or leak resistant seal between the peripheral frame 62 and the inner and outer window panes 70, 72. The sequence of steps depicted for this method and the proceeding methods are for illustrative purposes only, and is not meant to limit any of the methods in any way as it is understood that the steps may proceed in a different logical order or additional or intervening steps may be included without detracting from the invention.

The process 200 begins with assembling the spacer 74 and the edge seal element 76 between the confronting inner surfaces 70*a*, 72*a* of the outer and inner window panes 70, 72 at 202. Assembling the spacer 74 and edge seal element 76 with the outer and inner window panes 70, 72 can include the application of one or more sealants between the components. For example, a sealant can be provided between the spacer 74 and the edge seal element 76 and/or between the inner surfaces 70*a*, 72*a* and the spacer 74 and/or the edge seal element 76. Non-limiting examples of suitable types of sealants include silicone, a butyl rubber based sealant, a polyisobutylene sealant, and combinations thereof.

At 204, the second, inner seal 100 can be applied about the periphery of the outer surface 72*b* of the inner pane 72. The inner seal 100 is applied such that it will be positioned between the inner flange 92 of the inner frame element 62*a* and the outer surface 72*b* of the inner pane 72 in order to provide a seal between the inner flange 92 of the inner frame element 62*a* and the outer surface 72*b* of the inner pane 72.

At 206, the inner and outer frame elements 62*a*, 62*b* of the peripheral frame 62 can be assembled so that the weld flange and the channel located on the inner and outer frame elements 62*a*, 62*b* interlock with one another. In this way, the peripheral frame 62 is positioned about the periphery of the assembled spacer 74 and peripheral edges 70*c*, 72*c* of the outer and inner window panes 70, 72.

At 208, the continuous waterproof weld joint 62*c* is formed in a welding process to sandwich the assembled window panes 70, 72 and spacer 74. During the welding process, the spacer 74 provides support to the outer and inner window panes 70, 72 to prevent the window panes 70, 72 from being damaged due to the compression. The material forming the spacer 74 as well as the dimensions of the spacer 74 can be configured to provide sufficient support for the window panes 70, 72 during the welding process.

In an exemplary embodiment, the peripheral frame 62 and the spacer 74 are made from a base resin, preferably a polypropylene-based resin. Furthermore, one or both of the peripheral frame 62 and the spacer 74 are made from a material that includes a polypropylene-based resin and one more additives, including a filler. The filler can be used to increase the strength of the peripheral frame 62 and the spacer 74, which may be the same or different in the peripheral frame 62 and the spacer 74. The amount of filler present in the spacer 74 can be selected so as to fulfill the requirements of strength necessary to support the inner and outer panes 72, 70 as they are sandwiched between the inner and outer frame elements 62*a*, 62*b* of the peripheral frame 62. Non-limiting examples of suitable fillers include fiberglass, minerals, glass, mica, calcium carbonate, sand, quartz, carbon black, nanotubes, glass spheres, and talc.

The base resin for the peripheral frame 62 and the spacer 74 are also preferably selected to be compatible with the environment inside the dish treating appliance's treating chamber 16. During a cycle of operation, the components of the dish treating appliance 10 in fluid contact with the treating chamber 16 can be exposed to a variety of treating agents and debris and variations in temperature and moisture. Polypropylene-based resins have been found to be satisfactorily compatible with the conditions inside the treating chamber 16. Alternative resins, such as polyvinylchloride, are generally not satisfactorily compatible with the conditions inside the treating chamber 16. For example, polyvinylchloride can be damaged by repeated exposure to detergent, in some cases.

Figure 8:
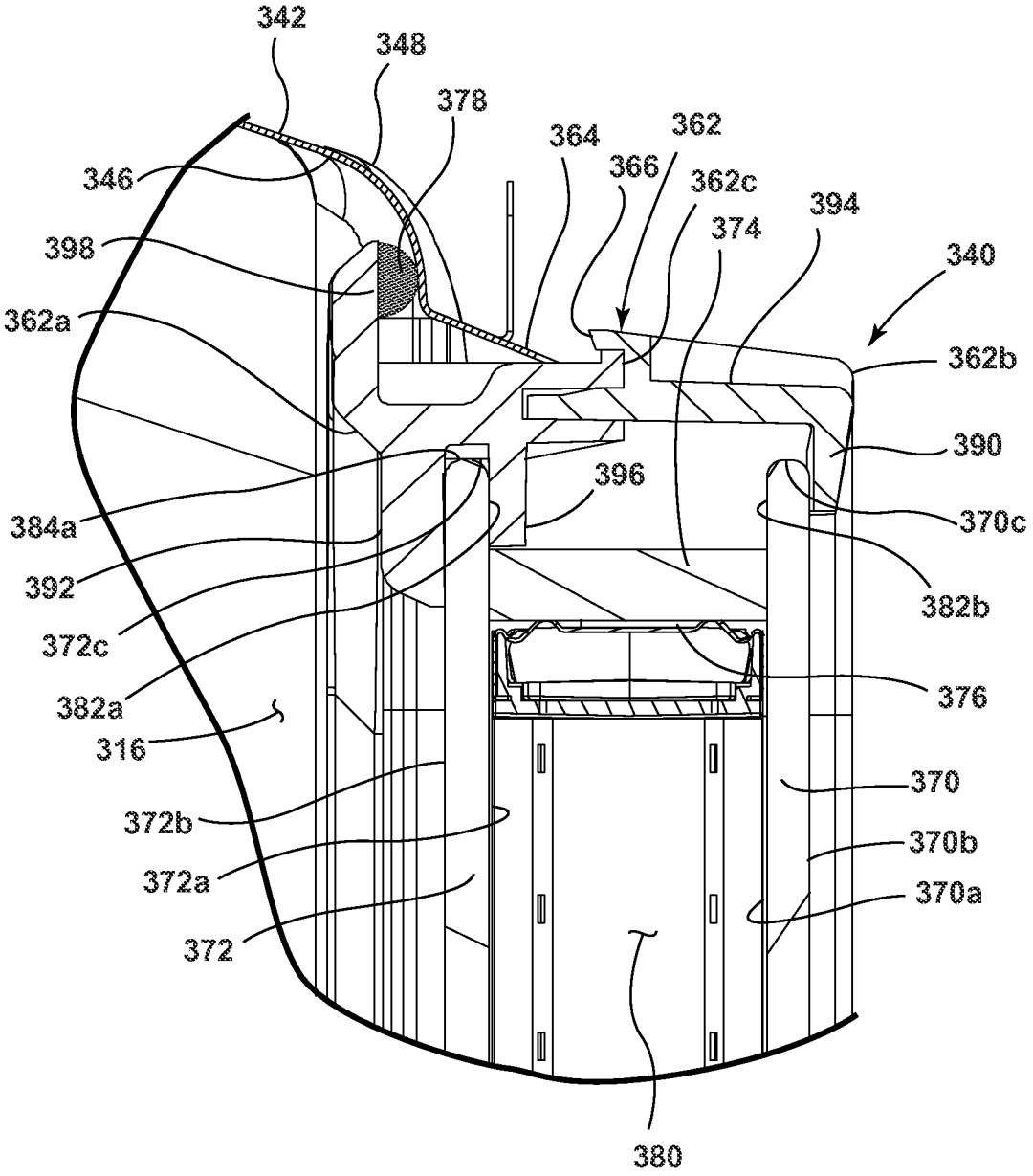
FIG. 8 is a cross-sectional view of a portion of an inner door panel assembly according to an embodiment of the invention.

FIG. 8 illustrates another embodiment of a window assembly 340 that is similar to the window assembly 40 of FIG. 6 except for the configuration of the inner frame element 362*a* about the inner pane 372 and the lack of an inner seal 100. Therefore, elements of the window assembly 340 similar to those of the window assembly 40 are labeled with the prefix 300. The window assembly 340 can be used with the interior door panel 42 in a manner similar to that described above with respect to the window assembly 40.

Still referring to FIG. 8, the inner frame element 362*a* can be overmolded about the peripheral edge 372*c* of the inner window pane 372 in an injection molding process to encapsulate the inner window pane 372. In addition to the inner flange 392 that overlies the outer surface 372*b* of the inner pane 372, extending about a periphery of the inner pane 372, the inner frame element 362*a* also has a second flange 396 that overlies the inner surface 372*a* of the inner pane 372, extending about a periphery of the inner pane 372. The inner flange 392 and the second flange 396 form the encapsulation about the inner window pane 372.

The encapsulation of the inner pane 372 of the window assembly 340 by the inner frame element 362*a* of the peripheral frame 362 is provided to form a seal about the peripheral edge 372*c* of the inner window panes 372 to seal the chamber 80 from the exterior environment, particularly the environment within the treating chamber 16. During the overmolding process, the molten polymeric resin molds around the portions of the outer and inner surfaces 372*b*, 372*a* and peripheral edge 372*c* of the inner window panes 372 adjacent the inner and second flanges 392, 396 and forms a mechanical bond between these adjacent components as the polymeric resin shrinks and cools. While the encapsulation of the inner pane 372 is illustrated herein as fully wrapping around the peripheral edge 372*c* of the inner pane 372, it is also considered that the encapsulation is required only to form a seal and need not necessarily wrap fully around the glass. A nonlimiting example of an alternate configuration includes providing the peripheral edge 372*c* of the inner pane 372 with a shape or deformation that the inner frame element 362*a* can be overmolded to. For example, the peripheral edge 372*c* can have a projection, such as a rib, or a groove that the inner frame element 362*a* can encapsulate. As another example, the peripheral edge 372*c* of the inner pane 372 could have a semi-circular protruding profile such that the inner frame element 362*a* can encapsulate only the rounded peripheral edge 372*c* of the inner pane 372 without having to contact the outer or inner surfaces 372*b*, 372*a* of the inner pane 372.

During use of the dish treating appliance 10, water, treating chemistry, and debris can come into contact with any of the components of the dish treating appliance 10 in fluid communication with the treating chamber 16. If the window assembly 340 is not adequately sealed, liquid, and any materials carried by the liquid, such as food debris, can leak into the chamber 80 between the outer and inner window panes 370, 372, and form an undesirable film or sludge within the chamber 80 over time, which may become visible to the consumer. Even if the liquid evaporates within the chamber 80, debris, such as food debris or dissolved salts carried by the liquid, will remain and can build up over time. In some cases, the liquid may even leak to an exterior of the dish treating appliance 10. The encapsulation of the inner pane 372 of the window assembly 340 by the inner frame element 362*a* of the peripheral frame 362 is provided to form a seal about the peripheral edge 372*c* of the inner window pane 372 to inhibit leakage around and into the window assembly 340.

Because the encapsulation provides a waterproof seal between the inner frame element 362*a* and the inner pane 372, there is no need for the inner seal 100 as in FIG. 6. Furthermore, because of the waterproof encapsulation of the peripheral frame 362 about the inner pane 372, the joint 362*c* between the inner and outer frame elements 362*a*, 362*b* is no longer required to be waterproof to prevent the escape of water from around the window assembly 340 during operation of the dish treating appliance 10. Therefore, in this embodiment, the weld joint 362*c* would not be limited to waterproof compositions. Non-limiting examples of other examples of suitable joints between the inner and outer frame elements 362*a*, 362*b* include non-continuous welds, vibration welds, or snap-fit connection.

The door assembly 20 described herein includes a window assembly 40, 340 formed with first and second window panes that define an intervening sealed chamber. In a traditional door assembly in which two separate panels are individually attached, one to the exterior door panel and the other to the interior door panel, humidity and condensation may occur between the panels, which is difficult to prevent. The window assemblies 40, 340 described herein form a sealed chamber that minimizes the likelihood of moisture and debris entering the space between the first and second window panes that could obscure the view through the window assemblies 40, 340 or build-up over time.

To the extent not already described, the different features and structures of the various embodiments of the invention may be used in combination with each other as desired. For example, one or more of the features illustrated and/or described with respect to one of the window assemblies 40, 340 may be used with or combined with one or more features illustrated and/or described with respect to the other of the window assemblies 40, 340. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dish treating appliance for treating dishes according to an automatic cycle of operation, the dish treating appliance comprising:

a tub at least partially defining a treating chamber receiving dishes for treatment according to the automatic cycle of operation;

an access opening provided in the tub and through which is had access to the treating chamber;

a door movable relative to the tub to selectively open and close the access opening, and the door having an inner surface confronting the access opening when the door closes the access opening and an outer surface, opposite the inner surface; and a window assembly provided in the door and having spaced and sealed inner and outer panes sandwiched between inner and outer frame elements connected by a waterproof weld joint, wherein the inner frame element comprises a second flange overlying the inner surface of the door.

2. The dish treating appliance of claim 1 further comprising an inner seal between the inner frame element and the inner pane.

3. The dish treating appliance of claim 2 wherein the inner seal is a foam-in-place seal.

4. The dish treating appliance of claim 2 wherein the inner frame element comprises an inner flange overlying the inner pane and the inner seal is positioned between the inner flange and the inner pane.

5. The dish treating appliance of claim 4 wherein the outer frame element comprises an outer flange overlying the outer pane.

6. The dish treating appliance of claim 5 wherein the inner flange and inner seal extend about the periphery of the inner pane and the outer flange extends about the periphery of the outer pane.

7. The dish treating appliance of claim 6 wherein the inner and outer flanges compressively retain the inner and outer panes.

8. The dish treating appliance of claim 7 wherein the waterproof weld joint comprises a channel on one of the inner or outer frame elements and a weld flange on the other of the inner or outer frame elements, with the weld flange received within the channel and welded together.

9. The dish treating appliance of claim 8 wherein the waterproof weld joint extends about the periphery of the panes.

10. The dish treating appliance of claim 9 wherein the waterproof weld joint is continuous.

11. A dish treating appliance for treating dishes according to an automatic cycle of operation, the dish treating appliance comprising:

a tub at least partially defining a treating chamber receiving dishes for treatment according to the automatic cycle of operation;

an access opening provided in the tub and through which is had access to the treating chamber;

a door movable relative to the tub to selectively open and close the access opening, and the door having an inner surface confronting the access opening when the door closes the access opening and an outer surface, opposite the inner surface; and a window assembly provided in the door and having spaced and sealed inner and outer panes sandwiched between inner and outer frame elements connected by a waterproof weld joint;

wherein at least one of the inner and outer frame elements encapsulates at least one of the panes.

12. The dish treating appliance of claim 11 further comprising an inner seal between the inner frame element and the inner pane.

13. The dish treating appliance of claim 12 wherein the inner seal is a foam-in-place seal.

14. The dish treating appliance of claim 12 wherein the inner frame element comprises an inner flange overlying the inner pane and the inner seal is positioned between the inner flange and the inner pane.

15. The dish treating appliance of claim 14 wherein the outer frame element comprises an outer flange overlying the outer pane.

16. The dish treating appliance of claim 15 wherein the inner flange and inner seal extend about the periphery of the inner pane and the outer flange extends about the periphery of the outer pane.

17. The dish treating appliance of claim 16 wherein the inner and outer flanges compressively retain the inner and outer panes.

18. The dish treating appliance of claim 17 wherein the waterproof weld joint comprises a channel on one of the inner or outer frame elements and a weld flange on the other of the inner or outer frame elements, with the weld flange received within the channel and welded together.

19. The dish treating appliance of claim 18 wherein the waterproof weld joint extends about the periphery of the panes.

20. The dish treating appliance of claim 11 wherein the inner frame element further comprises a second flange overlying the inner surface of the door.

* * * * *